United States Patent [19]

Molby

[11] 4,222,186

[45] Sep. 16, 1980

[54] ADAPTABLE COMBINATION OF VEHICLE AND ATTACHMENTS

[76] Inventor: Lloyd A. Molby, Box 7788, Longview, Tex. 75602

[21] Appl. No.: 919,179

[22] Filed: Jun. 26, 1978

[51] Int. Cl.[2] ..... E02F 3/72

[52] U.S. Cl. ..... 37/86; 37/81; 37/117.5; 37/DIG. 3; 298/17 R; 414/634; 414/686; 414/694; 414/786; 212/181

[58] Field of Search ..... 414/694, 695, 686, 917, 414/697, 700, 706, 715, 786, 691, 692, 634; 172/272, 273, 274, 275, 307; 298/10, 1 R, 22 R, 17 R; 212/59 R; 37/117, 5, 191 R, 81, 191 A, 192 R, 192 A, 83, 86, DIG. 3

[56] References Cited

U.S. PATENT DOCUMENTS

| | | | |
|---|---|---|---|
| 3,403,802 | 10/1968 | Lundell | 37/117.5 X |
| 3,811,581 | 5/1974 | Van Der Lely | 414/686 |
| 3,911,602 | 10/1975 | Trevathan | 37/117.5 X |
| 4,087,009 | 5/1978 | Profenna et al. | 414/686 |

*Primary Examiner*—Frank E. Werner
*Attorney, Agent, or Firm*—Wofford, Fails & Zobal

[57] ABSTRACT

An improved method and combination facilitating interchanging attachments on an adaptable off-road vehicle characterized by, in addition to the usual vehicle and its controls, prime mover, power source, drive apparatus, steering apparatus and the like, a first portion of attachment apparatus carried by the vehicle including a plurality of mounting stations on respective front pair of elongate substantially horizontal tracks and front and rear pairs of vertical tracks; the tracks being spaced apart a first predetermined distance; each mounting station having a plurality of apertures that are laterally aligned for even mounting of the attachments; a plurality of attachments, each having respective second portion of attachment apparatus, each second portion including a pair of track engaging clevises laterally spaced apart the first predetermined distance and having a plurality of apertures adapted to align with the apertures at the mounting stations; a plurality of pins for inserting through the aligned apertures in the attachment apparatus and quick-connect fittings carried by the frame and by each attachment for a supplying operating power. Also set forth are preferred embodiments.

16 Claims, 10 Drawing Figures

Fig. 1
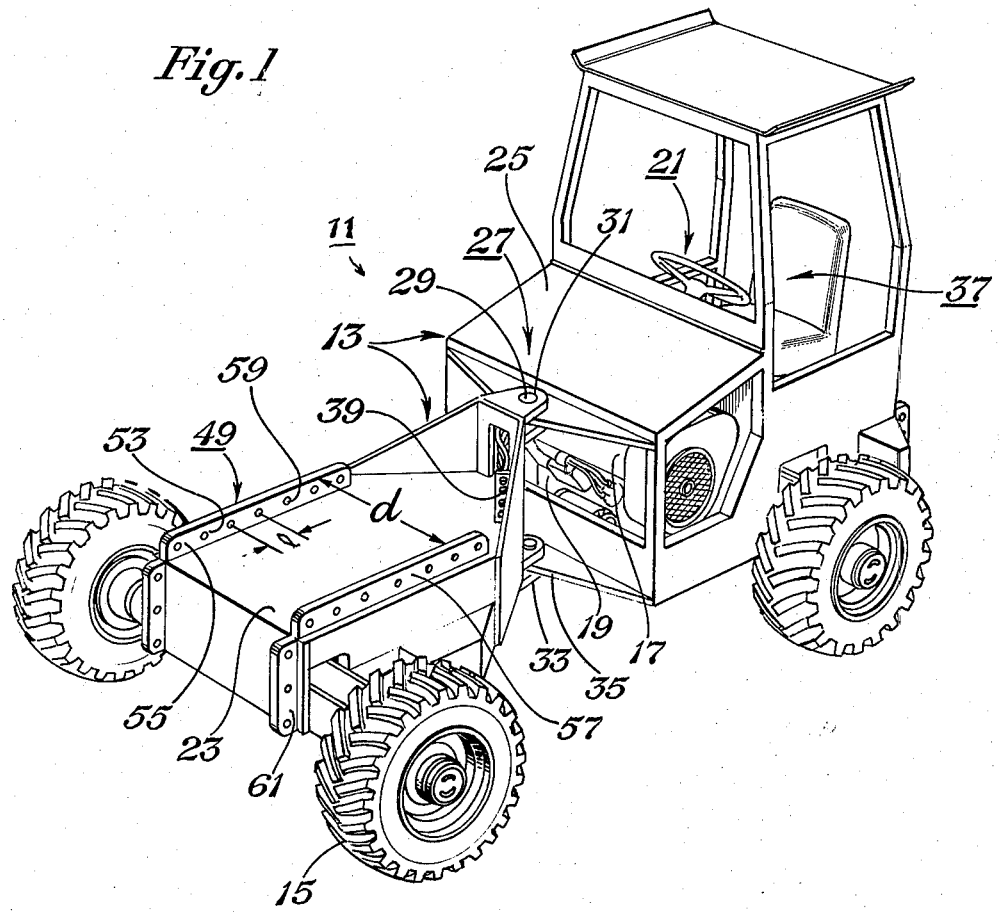
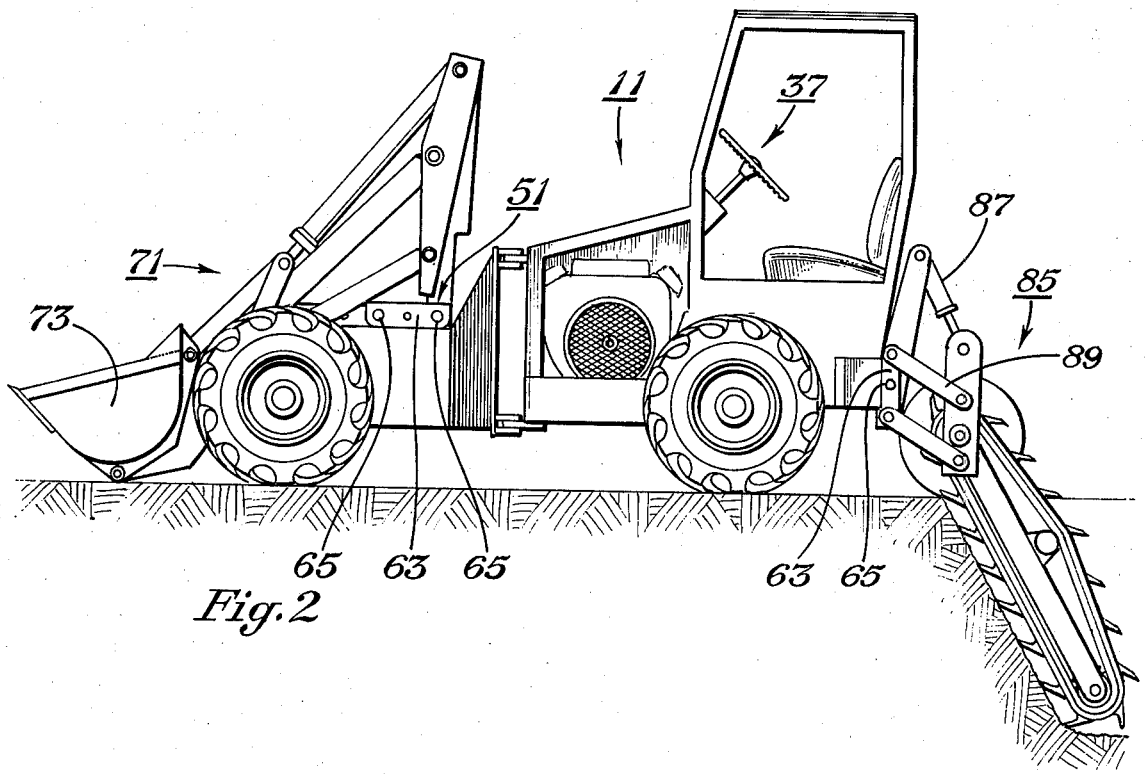
Fig. 2

ADAPTABLE COMBINATION OF VEHICLE AND ATTACHMENTS

BACKGROUND OF THE INVENTION

1. Field of the Invention

This invention relates to a combination of vehicles of the so called "off-road" type and attachments therefor. More particularly, this invention relates to construction equipment embodying the combination of an adaptable off-road vehicle and a variety of attachments therefor together with the method and means for readily and easily mounting and removing the attachments to facilitate cooperative working and more fully utilizing the time of the vehicle.

2. A wide variety of off-road type vehicles have been known in the prior art. Each type of vehicle has been expensive and not utilized fully, since it was ordinarily connected with a particular type of attachment. For example, graders were employed for grading roads but that were not otherwise widely useful. Similarly, front end loaders were available for scooping up the materials that the graders had scraped to a certain spot but were not used all the time. Similarly, augers, load carrying devices such as dump beds, ditch digging equipment, back-hoes, revolving jib cranes and fork lifts were all mounted on their own type vehicles. It has been particularly found desirable to have co-mounted cooperative units such as ditch digging equipment and front end loading equipment on the same vehicle.

Heretofore, however, the job of mounting and removing the respective attachments has been either prohibitively time consuming or has required auxiliary equipment and personnel. Frequently the vehicles had inferior mounts that would not take the strain. Moreover, where a plurality of mounting stations are employed, one or more of the mounting stations that were not in use would become fouled by accumulation of mud, debris and the like such that it took a prohibitively long time to clean up the mounting station or subsequence mounting of an attachment.

From the foregoing it can be seen that the prior art was not totally satisfactory in providing a combination of an off-road vehicle, attachments therefor and attachment means that facilitated readily mounting and removing the respective attachments so as to be useful.

Specifically, the prior art has been less than totally satisfactory in providing the means and method for mounting attachments onto an adaptable off-road vehicle whereby a single operator could make the mounting or the removal.

SUMMARY OF THE INVENTION

Accordingly it is an object of this invention to provide a combination of an adaptable off-road vehicle, attachments therefor and attachment means that facilitate mounting and removing attachments, alleviating the problems of the prior art.

It is a specific object of this invention to provide means and method facilitating the mounting and removal of attachments for an off-road vehicle to employ the vehicle more nearly completely; yet, enable mounting and removing the attachments by the single operator without requiring helpers; thereby obviating the difficulties and the deficiencies of the prior art.

These and other objects become apparent from the descriptive matter hereinafter, particularly when taken in conjunction with the appended drawings.

In accordance with one aspect of this invention there is provided a combination of an adaptable off-road vehicle, attachments therefor, and attachment means facilitating mounting and removal of the attachments comprising:

a. a frame carrying a prime mover and drive means and controls for controlling movement of the vehicle;
b. a plurality of at least three wheels carrying said frame;
c. steering means for steering the vehicle;
d. a power source for operating the attachments;
e. quick-connect fittings carried by the frame and each of the attachments for supplying power for operating the attachments;
f. a first portion of attachment means carried by the frame and including a front pair of elongate substantially horizontal track means and a front pair of vertical track means; the track means being spaced apart a first predetermined distance; each of the track means having at least one mounting station with the horizontal track means having a plurality of mounting stations; each mounting station including a plurality of apertures in the spaced apart track means; the apertures being laterally aligned for even mounting of the attachments at one of the respective mounting stations;
g. a plurality of attachments, each having respective second portions of attachment means connected therewith; each second portion including a pair of track engaging means laterally spaced apart a predetermined distance and having a plurality of apertures adapted to align with the apertures in the first portion of the attachment means on the vehicle; and
h. pin means for inserting through aligned said apertures in the first and second portions of attachment means such that one or more of the attachments can be attached at respective ones of the plurality of the mounting stations longitudinally of the frame of the vehicle and readily mounted and removed.

In preferred embodiments each of the mounting stations has a plurality of apertures disposed at respective second predetermined distances longitudinally along each of the track means; each of the track means on the vehicle where it is subjected to mud accumulations comprises a lug that is solid except for the apertures and the second portion of the attachment means on the attachments comprises a pair of clevises that will engage the lugs and have a plurality of apertures disposed at the respective second predetermined distance longitudinally along the depending portion of the U-shaped clevis and located for aligning with the apertures in the lugs on the vehicle.

In another aspect of the invention there is provided a method of mounting and removing rapidly and readily attachments to and from a multipurpose off-road vehicle having the usual frame carried by a plurality of wheels and carrying a prime mover and power source for operating the attachments, the improvement comprising:

a. providing a first portion of attachment means comprising a plurality of mounting stations along respectively a front pair of substantially horizontal track means and at each of the front and rear of the vehicle respective pairs of vertical track means; each of the track means being spaced apart a first predetermined distance; and providing a plurality of laterally aligned apertures at each of the mounting stations;

b. providing a plurality of attachments, each having a second portion of attachment means comprising a pair of track engaging means adapted to fittingly engage a pair of the track means at each mounting station; the track engaging means having a plurality of apertures adapted to align with the apertures in the track means at the respective mounting stations;

c. providing pin means for inserting through aligned said apertures in the first and second portions of the attachment means; and d. emplacing the second portion of the attachment means engaging the first portion of the attachment means on the vehicle and inserting the pin means in the apertures that have been aligned for mounting the attachments; and e. removing the pin means from the apertures for removing the attachment when it is ready to be removed.

BRIEF DESCRIPTION OF THE DRAWINGS

FIG. 1 is an isometric view of an adaptable off-road vehicle in accordance with one aspect of this invention.

FIG. 2 is a side elevational view of the off-road vehicle of FIG. 1 having a front end loader mounted at the front and a ditching machine mounted at the rear.

DESCRIPTION OF THE PREFERRED EMBODIMENTS

Figure 3:
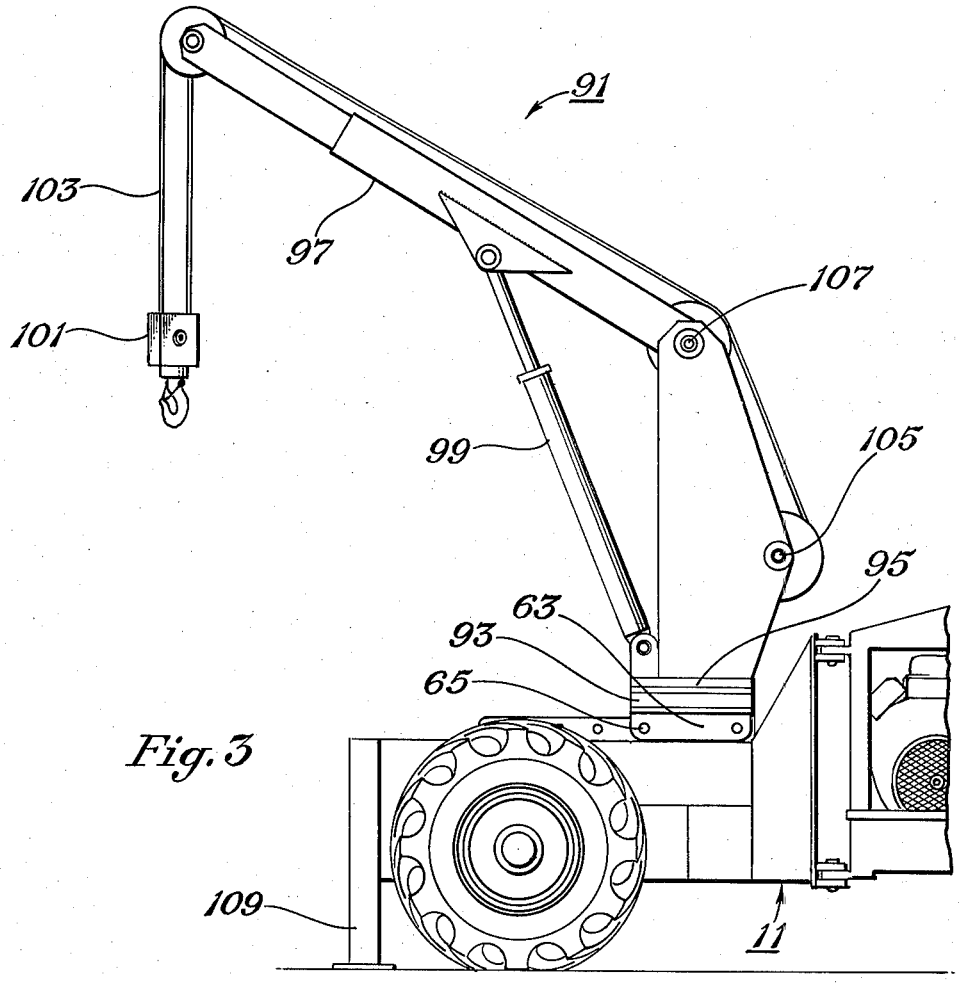
FIG. 3 is a partial side elevational view of the front of the vehicle of FIG. 1 having a revolving jib crane mounted at one of the mounting stations.

This invention can be understood more clearly by referring to the figures in conjunction with the following descriptive matter. Referring to FIG. 1, the adaptable off-road vehicle 11 has its frame 13 mounted on wheels 15. The frame 13 carries a prime mover 17 for powering the vehicle 11 and driving a power source 19 for powering and operating the respective attachments. A steering means 21 is provided for steering the vehicle.

The vehicle 11 comprises a front portion 23 and a rear portion 25. The vehicle 11 in the illustrated embodiment is an articulated vehicle, articulating about a central vertical axis 27. The axis 27 comprises a plurality of pins 29 inserted through respective apertures 31 in the respective clevises 33 emplaced over the steering lug 35 with the apertures in alignment for receiving the pins 29.

The frame 13 is formed of suitably strong structural materials, such as steel or the like, that has been welded into place to support the respective elements in accordance with the conventional engineering technology. The rear portion 25 encloses the operators console 37 having usual controls, seat and the like.

The respective wheels 15 may comprise any of the usual type of wheels. As illustrated, they include hydraulic motor drive with tires around the periphery. Four wheels 15 are employed for supporting in a very stable manner each of the four corners of the frame 13.

The prime mover 17 is an internal combustion engine; specifically, a diesel in the illustrated embodiment. It drives the power source which comprises a pair of hydraulic pumps for putting out hydraulic fluid for a hydrostatic drive system as well as a hydraulic system for powering the respective attachments.

The steering means 21 comprises the usual steering wheel and hydraulic ram operable to effect articulation of the frame 13 about the central vertical axis 27.

Figure 9:
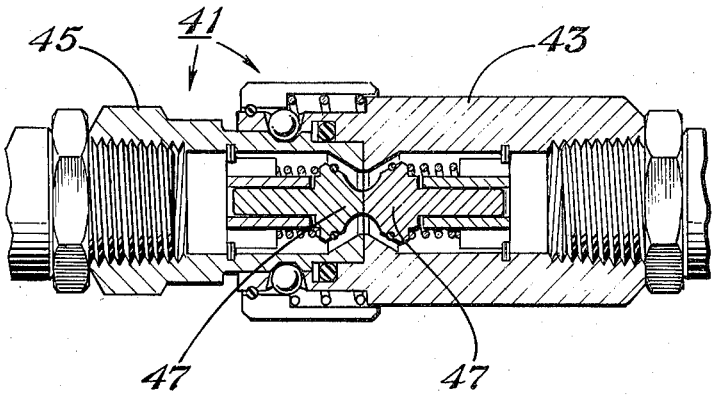
FIG. 9 is a partial side elevational view, partly schematic of one of the quick-connect fittings facilitating connecting power lines for operating the attachments.
Figure 10:
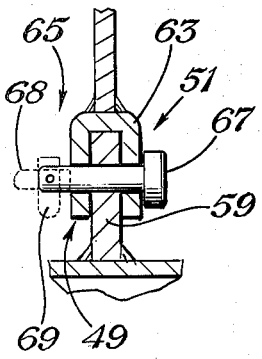
FIG. 10 is a partial cross-sectional view of a pin means inserted through aligned apertures of an attachment means.

Expressed otherwise, the basic vehicle is a tractor that has a four-wheel drive and articulated power unit and is adaptive to use remotely operated, hydraulically powered tools, or attachments, that are fastenable to the machine. The hydraulic power unit, can accommodate high pressure circuits of from two gallons a minute up to eight gallons a minute on one auxiliary system and six gallons a minute to twenty six gallons a minute in the main hydraulic circuits for driving the attachments. The vehicle 11 has plug-in quick-connect hydraulic circuit fittings 39 that enable the hydraulic lines on the respective attachments to be plugged in in the same way that an electric cord may be plugged into a wall socket. Specifically, quick-connect fittings 41, FIG. 9, facilitate the interconnections and the disconnections. A female receptacle 43 is adapted to sealingly receive a male insert 45. Each of the respective male and female fittings have respective valves 47 immediately adjacent thereto for preventing flow when the fittings are unplugged. Expressed otherwise, the valves are conventional but operate to allow flow as necessary to operate the attachment when the respective fittings 43 and 45 are plugged in but close upon disconnect to prevent loss of hydraulic fluid.

The illustrated embodiment of the vehicle is available in either standard or heavy duty versions. The vehicle will handle, for example, up to 5000 pounds on the fork lift attachment. As illustrated, the wheels on the heavy duty version employ tires that are nineteen inches wide. The vehicle steers 90 degrees total articulation, 45 degrees each side of the central longitudinal axis.

One of the primary features of this invention is the attachment means that facilitate readily and rapidly mounting and removing attachments as desired. A first portion 49, FIG. 1, of the attachment means is connected to the vehicle and a second portion 51, FIG. 2, is connected to the respective attachments.

The first portion 49 of the attachment means includes a front pair of track means 53 that are elongate and substantially horizontal and placed on the horizontal section of the front portion 23. Respective track means 53 are spaced apart a first predetermined distance d. The horizontal track means 53 include a plurality of mounting stations that include a forward mounting station 55 and a rearward mounting station 57. As illustrated in FIG. 1, the respective track means 53 are in the form of solid elongate lugs that are displaced laterally the distance d and have a plurality of apertures 59 spaced longitudinally along each of the track means. The apertures are spaced longitudinally of the track means at a predetermined second distance; for example, about six inches apart. This flexibility allows any one or more of the attachments to be mounted at respective times along any one of the plurality of mounting stations along the horizontal track means. For example, it allows a front end loader to be mounted at the rearward mounting station for greater load bearing capabilities; or mounted at the forward mounting station so as to allow operating near ditches or the like without requiring that the vehicle be moved so close to the ditch so as to cause cave-ins or otherwise interfere with the job site.

The first portion of the attachment means also includes front and rear mounting stations at the respective front and rear of the vehicle 11. Each mounting station includes a pair of respective track means 61 spaced apart a predetermined distance d. As illustrated, the respected front and rear mounted track means are vertical pairs of track means that have a plurality of apertures for each mounting station.

Preferably, there are a plurality of apertures spaced longitudinally along each of the respective track means at the second predetermined distance l such that the respective attachments can be mounted also at the front or rear of the vehicle as desired. Each of the vertical track means, similarly as described with respect to the horizontal track means, preferably comprises solid lug that resists invasion of mud and the like and is easier to clean than would be clevis-type dual track structure. The dual track structures can be employed, however, and were employed in the early prototypes.

The second portion 51 of the attachment means, comprise respective track engaging means that are connected with the respective attachments. Each of the second portion includes a pair of the track engaging means that are laterally spaced apart the predetermined distance d, centerline to centerline and have a plurality of apertures that are adapted to align with the apertures in the first portion 49 of the attachment means. As will be appreciated, an elongate track engaging means can employ a single aperture on each side to engage a single aperture along the respective track means such that the attachment would be immobilized, or become fixedly attached to the frame 13. Preferably, however, there are a plurality of apertures on each side of the respective track engaging means that are spaced apart longitudinally the same second predetermined distance as are the apertures along the respective track means. In this way, somewhat less care need be taken to ensure that the track engaging means fit exactly. Moreover, wear can be accommodated for by having the plurality of longitudinally spaced apertures in the respective track means and the track engaging means pinned together. Specifically, in the illustrated embodiment, the track engaging means comprise respective clevises 63 on each side for engaging the respective track means 53, or the other respective mounting stations. The clevises 63 have a plurality of apertures 65 disposed longitudinally therealong for aligning with the apertures 59 in the respective track means. Thus a given attachment can be emplaced simply by emplacing the clevises over the tracks to engage the tracks and aligning the apertures.

To fix the respective attachments at their respective mounting stations, a plurality of pin means 65, FIGS. 2–8 and 10, are inserted through the aligned apertures in the first and second portions 49, 51 of the attachment means. Each of the pins 65 may be of any desired form. For example, they may be bolt like structures with clip holders to maintain in place. Preferably, they have a structure similar to that illustrated in FIG. 10. Therein each pin 65 is tapered to allow easy insertion and has two cross drilled holes 66, one in each end in which to insert a spring retaining pin 67. Spring loop 69 is hinged outward to allow insertion of pin 68 into hole 66 and spring loop 69 is hinged inward to rest against pin 68 to retain pin 65 in place and prevent accidental removal. In this position, the pin 65 holds the apertures aligned with the clevis 63 engaging the track means 59.

Each of the respective attachments are, per se, conventional in the sense that they have been employed heretofore in the prior art heavy equipment in construction and the like. Consequently, this application need not be burdened with detailed description of the respective attachments which can be bought commercially. It is sufficient to note that in this invention, the respective second portion 51 of the attachment means are connected at the ends of the respective attachments that are to be connected with the vehicle 11. The connection of the attachment with the second portion 51 of the attachment means may be by welding of the steel portions together, as is the usual case; or it may be by any of the other approved techniques that will withstand the structural requirements. Such other techniques are the bradded steel plates, bolted engaging portions and the like.

In operation, the vehicle 11 is assembled as shown in FIG. 1 and as described hereinbefore. Conventional engineering technology is employed in such assembly and it may be done on each individual machine or on an assembly line basis. One of the benefits of the vehicle of this invention is that it can be built on an assembly line basis and, because of its flexibility, satisfy the demands of a wide range of consumers and ultimate users.

The respective attachments that can be employed are almost without limit and more will become available as the technology grows and the use of this invention increases. Typical and currently available attachments can be seen from consideration of the FIGS. 2–8.

Figure 8:
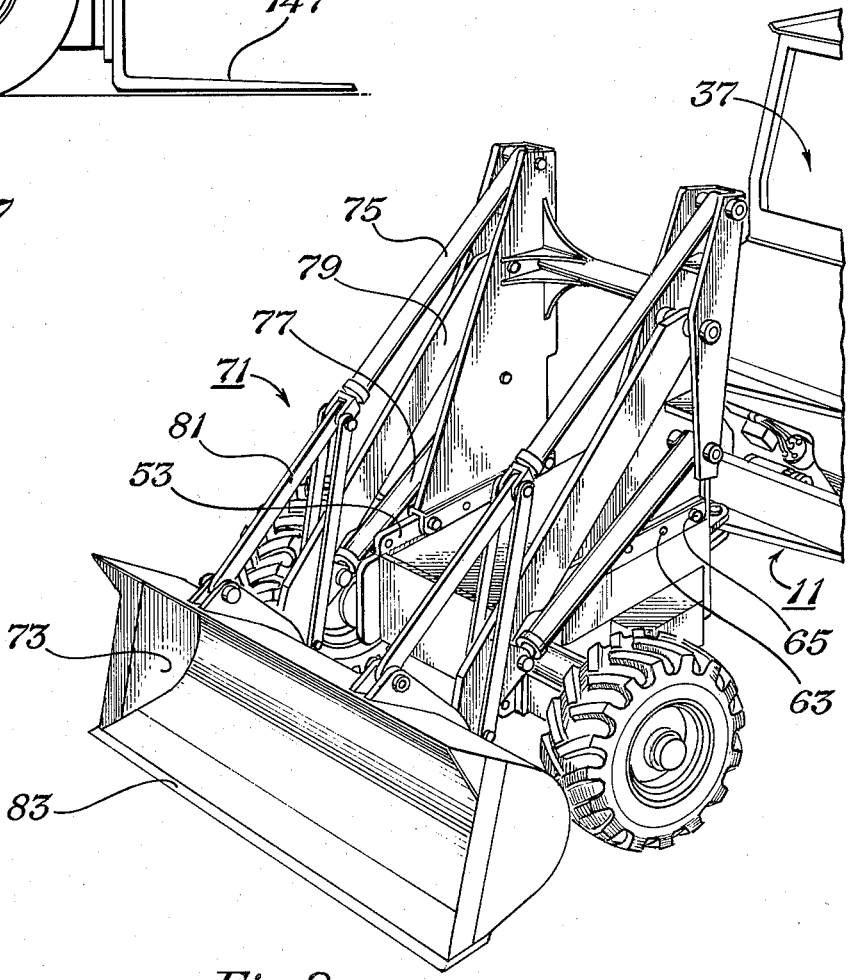
FIG. 8 is a partial isometric view showing the front end of the vehicle of FIG. 1 and more details of the front end loader.

According to FIGS. 2 and 8, a front-end loader 71 is mounted on the front of the vehicle 11. There in the clevises 63 are emplaced over and encompass the track means 53 at the rearward mounting station. Respective pins 65 are inserted through respective aligned apertures in the clevises 63 and track means 53 to hold the front-end loader in place against the forces caused by lifting dirt or the like in a bucket 73. As is recognized, the bucket 73 is raised and lowered by operation of the respective hydraulic rams 75 and 77. The respective piston rods of the rams 75 and 77 are extended or retracted by hydraulic fluid supplied through respective hoses responsive to suitable controls (not shown) in the operator's console 37. Hydraulic hoses to operate the respective hydraulic ram 75 and 77 are not specifically illustrated in FIGS. 2 and 8, since they may be taped closely to cylinders of the rams and thence sent through the nonmoving portion of the frame work to the hydraulic fittings 39, FIG. 1. These hydraulic hoses are connected in a conventional manner and the hose's interconnection need not be described herein other than what has been already been given with respect to the quick-connect fitting, FIG. 9. The mechanical members such as load bearing members 79 having the bucket pivoted and mounted on their free end and the pivoting triangular members 81 also are conventional and need not be described in any greater detail than illustrated in FIG. 8, for example. It is sufficient to note that the bucket can be emplaced with its blade 83 horizontal for scraping or the like, tilted up into the load carrying position shown in FIG. 2, or elevated and dumped into a dump truck or the like.

Also as illustrated in FIG. 2 there is attached at the rear mounting station ditching apparatus 85. The ditching apparatus is mounted at the rear mounting station by having its clevis 63 being placed over the vertical track means such as track 61, FIG. 1, and the pins 65 inserted through the aligned apertures. The hydraulic quick-connect fittings 41 are connected and the ditching apparatus operated by hydraulic motors responsive to the operators controls in the operators console 37. The ditching apparatus, per se, similarily as with the front-end loader, is conventional. The ditching apparatus may be raised and lowered by suitable hydraulic power ram 87 and the parallelogram linkage arrangement 89 at each side.

The respective attachments such as the front end loader and the ditching apparatus 85 may be removed by the simple expedient of removing the pins 65 and lifting the second portion of the attachment means from the track engaged thereby. After removal, another attachment can be mounted at one or more of the mounting stations.

Referring to FIG. 3, a revolving jib crane 91 is mounted at the rearward mounting station on the front-end of the vehicle 11. As illustrated, the respective mounting clevises 63 are connected with a platform 93. The revolving jib crane 91 can be rotated by way of fifth wheel arrangement 95 via a hydraulically driven motor and gear arrangement (not shown). The elevation of the crane boom 97 may be controlled by way of hydraulic ram 99. The free end of the crane boom 97 may carry a block and tackle 101 or other suitable apparatus as desired. The block and tackle is moved upward or downward by way of cables 103 on a winch drum 105 that is similarly powered by a hydraulic motor. One end of the crane boom 97 is pivotal about the pivotal fulcrum pin 107. If desired, stabilizing legs and pads 109 can be employed on the front end of the vehicle.

As indicated hereinbefore, the respective hydraulic line interconnections have not been shown, since they are conventional. It is noteworthy, however, that sufficient length of the respective lines should be employed to accommodate the rotational, pivotal movement of the jib crane without causing disconnect of the quick-connect fittings.

Figure 4:
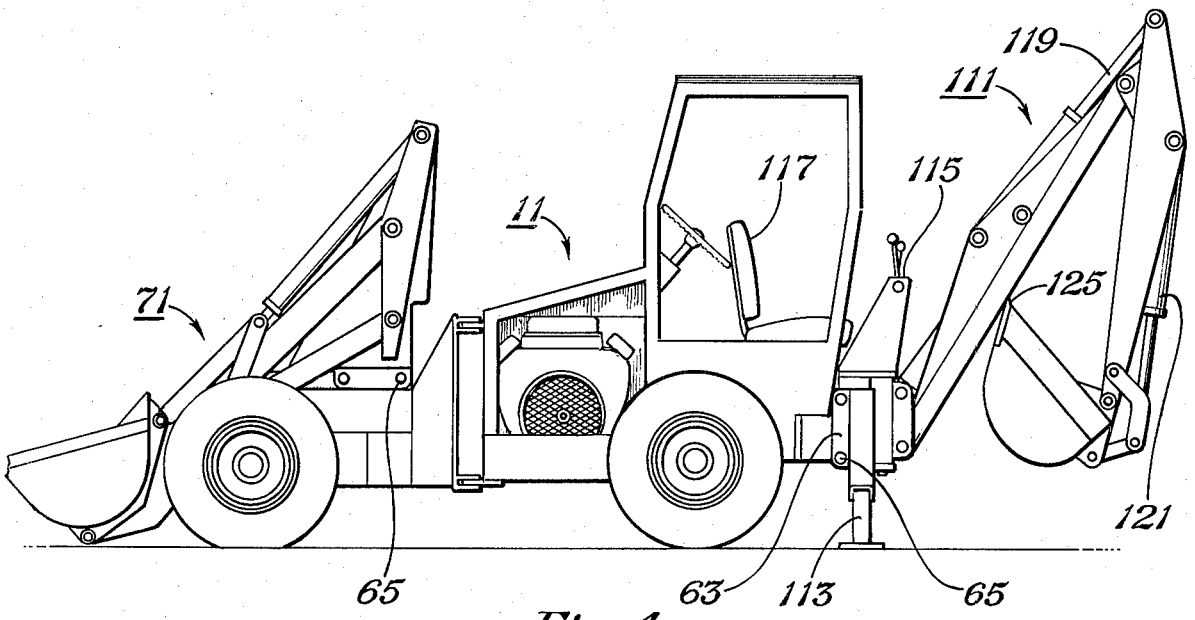
FIG. 4 is a side elevational view of the vehicle of FIG. 1 having a front end loader and a back-hoe mounted at the respective front and rear of the vehicle.

Referring to FIG. 4, the front-end loader 71 is again connected on the front horizontal track means of the vehicle 11 as described hereinbefore. At the rear of the vehicle 11, there is connected the backhoe 111. With the backhoe 111, it is preferred to use stabilizing legs and pads 113 to stabilize the vehicle 11. Note that the backhoe has its own set of controls 115. To facilitate operation, the operator seat 117 swings around. It is noteworthy that the backhoe stabilizing leg and pad 113, as well as the controls 115 are mountable on the rear track means by way of suitable clevises 63 serving as a track engaging means on each side of the vehicle, similarily as described hereinbefore. As it will readily be understood by those skilled in the art, the backhoe can be operated by way of the respective hydraulic rams 119, 121 operating responsive to hydraulic power supplied by way of hydraulic hoses from the controls 115. The hoses are not shown, since they are conventional. It is noteworthy in this regard that the hydraulic hoses upstream of the controls 115 are connected into quick-disconnect fittings 43 (not shown) on the vehicle 11 as described hereinbefore.

Thus, the operator can extend the hoe and dig out, with the toothed blade 125, the soil or the like. The mounting is made as described hereinbefore wherein pins 65 are inserted through aligned apertures in the clevises 63 and the encompassed track means on the rear of vehicle 11. The operation of the backhoe is conventional and need not be described in detail herein.

Figure 5:
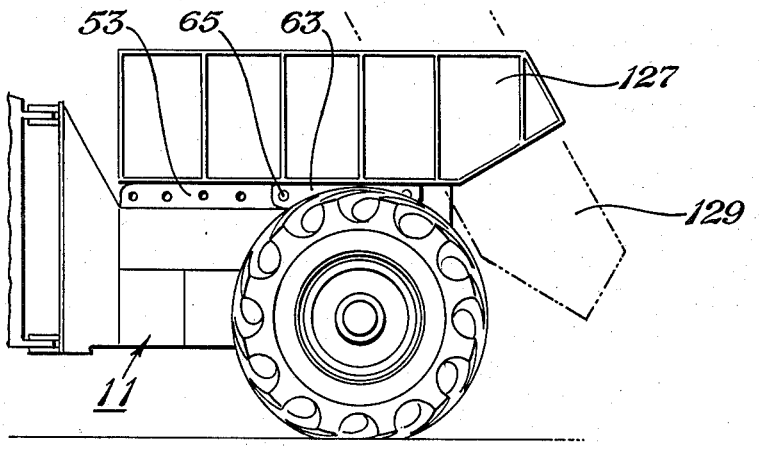
FIG. 5 is a partial side elevational view showing the front of the vehicle of FIG. 1 having a dump bed attached.

Referring to FIG. 5, the front of the vehicle 11 has mounted thereon a dump bed 127. The dump bed 127 is mounted by way of clevises 63 engaging the front track means 53 with pins 65 inserted through the apertures that have been aligned. The dump bed 127 is dumped, in the position shown in dashed lines 129, including being returned to its load-receiving position, by conventional dumping mechanism. The dumping mechanism may comprise a hydraulic motor running a gear and circular pinion, or, preferably, by hydraulic rams (not shown). In any event, the dumping mechanism is operated with hydraulic fluid supplied from the controls through high pressure hose (not shown).

Figure 6:
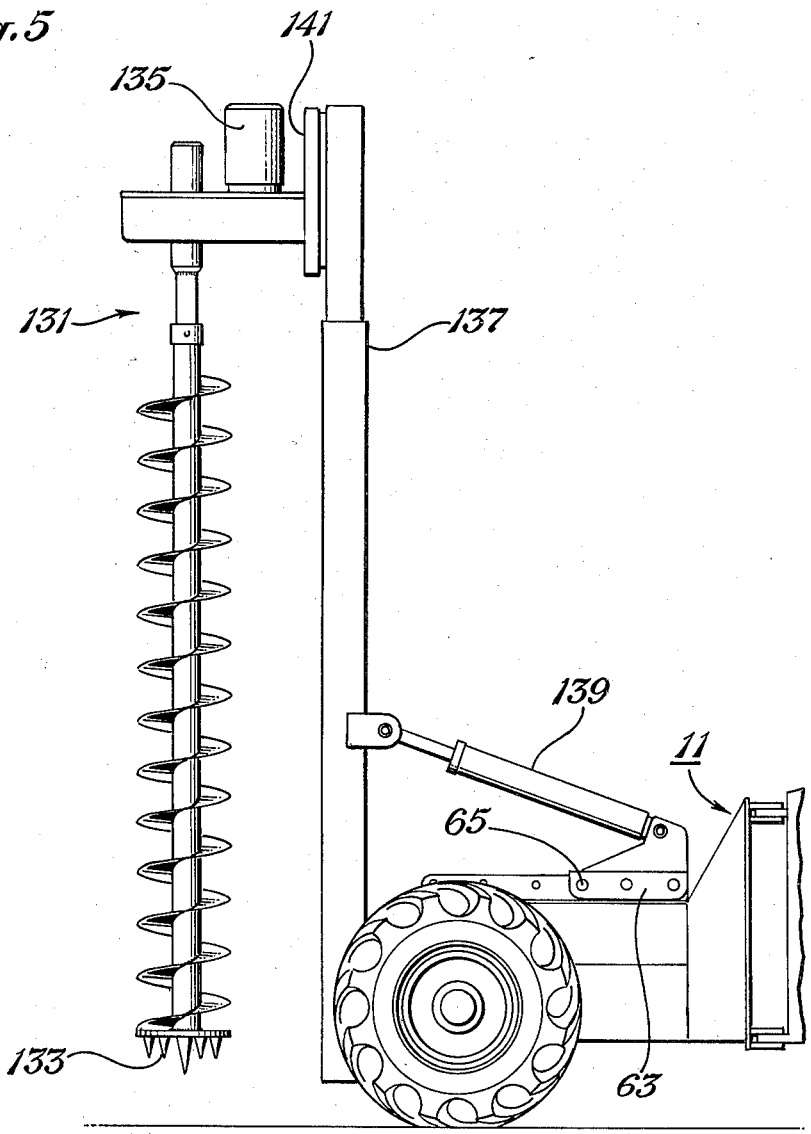
FIG. 6 is a partial side elevational view showing the front end of the vehicle of FIG. 1 having an auger attached.

Referring to FIG. 6, the vehicle 11 has an auger mounted on its front set of track means 53 by the usual clevises 63 having pins 65 inserted through aligned apertures through the clevises 63 and the track means 53. The auger 131 has an earth penetrating head, or bit, 133 and is rotated by gear engaging a circular pinion, the gear being driven by the hydraulic motor 135. The mast 137 that carries the auger is extensible by way of internally mounted hydraulic ram (not shown). The mast 137 is tiltable by way of hydraulic ram 139. The auger assembly is carried by way of a carriage 141 that traverses longitudinally of the mast 137 responsive to a hydraulic ram connected therebetween for forcing the auger downwardly into the earth. Again the hydraulic hoses are not shown since they are conventional. It is sufficient to note that the hydraulic hoses carry power to the respective rams or hydraulic motors as delineated by the operator in controlling the rotation of the auger and the downward movement of the auger 131 and its bit, or head, 133 into the earth. Similarily, the controls reverse and lift the auger out of the hole that has been bored.

When it is time to remove the auger, the pins 65 are removed from the apertures and the auger laid over to free it and allow the machine to be moved to have another attachment mounted thereon. The same removal technique is used in all of the attachments.

Figure 7:
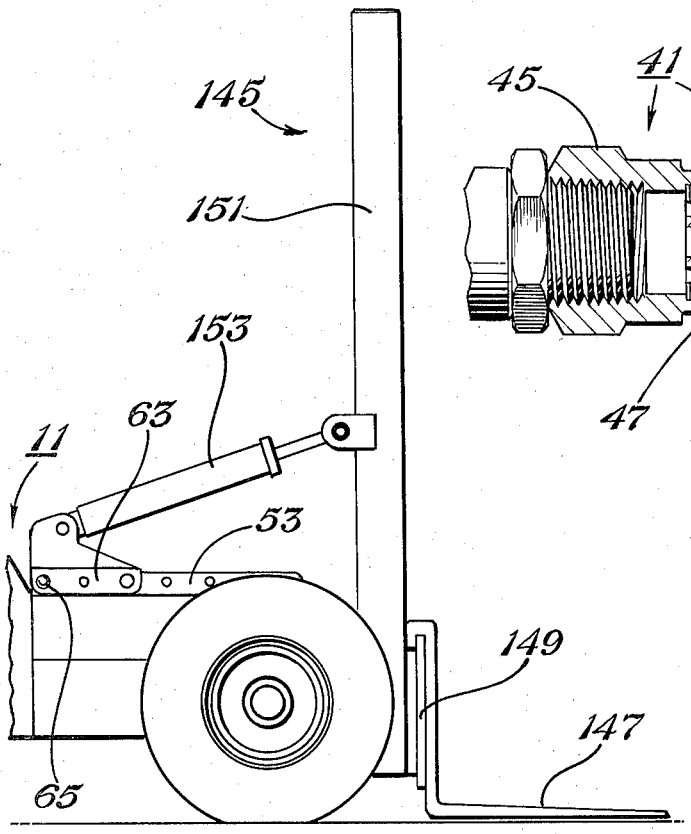
FIG. 7 is a partial side elevational view showing the front end of the vehicle of FIG. 1 having a fork lift attached.

Referring to FIG. 7, a forklift 145 mounted on the front of the vehicle 11 by way of the clevises 63 and the pins 65 inserted through the selective aligned apertures in the clevises and the track means 53 on the front of the vehicle. Similarily as described hereinbefore with respect to the auger, the prongs 147 and the platform carriage 149 are moved upwardly and downwardly by way of internally mounted ram (not shown) along the mast 151. The mast 151 may be tilted by operation of the hydraulic ram 153.

Similarily as described hereinbefore, the hydraulic hoses and innerconnections are not shown for the forklift.

When it is desired to remove the forklift, the pins 65 are removed from the apertures and the clevises freed from the respective pair of horizontal track means 53.

The respective means for elevating and operating the attachments have been illustrated as hydraulic transducers such as pistons and cylinder arrangements. Any other transducers that will effect the rotation of the rotary members and extension of the linear members can be employed.

The usual materials of construction are employed fabricating the vehicle and the attachments described herein. Ordinarily, steels are preferred because of their structural strength and ready amenability to the various operations; such as welding, milling and casting.

Hereinbefore the track means have been illustrated as being lugs with the track engaging means being clevises. If desired, the track means could be respective elongate clevises and the track engaging means could engaging lugs, clevises, or the like.

While the invention has been described with certain degree of particularity, it is understood that the present disclosure has been made only by way of example and numerous changes in the details of the structure and the combination and arrangement parts may be resorted to without departing from the spirit and scope of the invention, reference being had to the appended claims for the latter purpose.

What is claimed is:

1. A combination of adaptable off-road vehicle and attachments facilitating interchangeability of attachments for a multiplicity of purposes, comprising:

a. a frame carrying a prime mover and drive means and controls for controlling movement of said vehicle and power means for operating said attachments;

b. a plurality of at least three wheels carrying said frame;

c. means for steering said vehicle;

d. a first portion of attachment means carried by said frame and including a front pair of elongate substantially horizontal track means and a front pair of vertical track means; said track means being spaced laterally apart a first predetermined distance; said track means having a plurality of mounting stations each having a plurality of apertures; said apertures being laterally aligned for mounting of the attachments on respective mounting stations on one of the respective horizontal and vertical track means;

e. a plurality of attachments, each having respective second portions of attachment means connected with the respective attachments; each said second portion including a pair of track engaging means laterally spaced apart said first predetermined distance and being adapted to fittingly engage one of said pair of said track means; said second portion of attachment means having a plurality of apertures adapted to align with said apertures in said first portion of said attachment means on said vehicle; and f. pin means for inserting through aligned said apertures in said first and second portions of said attachment means;

such that respective said attachments can be moved to a plurality of locations longitudinally of said frame of said vehicle and readily mounted and removed as desired.

2. The combination of claim 1 wherein said horizontal track means have a plurality of mounting stations including at least a rearward mounting station and a forward mounting station, each station having a plurality of apertures for mounting said attachment thereat; said forward mounting station allowing extended forward operation of said attachment more remote from said vehicle than said rearward mounting station.

3. The combination of claim 2 wherein said vehicle also includes at its rear end a rear pair of vertical track means spaced apart said first predetermined distance for mounting said attachments whereby cooperating said attachments can be mounted both front and rear on said vehicle and be operated cooperatively without requiring mounting and removing of respective said attachments.

4. The combination of claim 3 wherein one of said attachments is a ditching mechanism that is mounted to said rear track means by said pivot pins in said apertures and the other of said attachments is a front end loader that is mounted on said front horizontal track means by said pin means in said apertures.

5. The combination of claim 1 wherein said attachment comprises a revolving jib crane that is mounted on said front horizontal track means.

6. The combination of claim 1 wherein said attachment comprises a dump bed that is mounted on said forward horizontal track means.

7. The combination of claim 1 wherein said attachment comprises a hole boring auger that is mounted on said front horizontal track means.

8. The combination of claim 1 wherein said attachment comprises a fork lift that is mounted on said front horizontal track means.

9. The combination of claim 1 wherein said vehicle also includes at its rear end a rear pair of vertical track means spaced apart said first predetermined distance and said attachment comprises a backhoe that is mounted on said rear pair of vertical track means.

10. The combination of claim 9 wherein said vehicle also has a front end loader mounted on said front horizontal track means.

11. The combination of claim 1 wherein said vehicle has a front end loader mounted on said front horizontal track means.

12. The combination of claim 1 wherein each said mounting station includes a plurality of apertures spaced longitudinally along each said track means for multiple point mounting on each said track means.

13. The combination of claim 1 wherein said track means comprises lugs that resist being fouled by deposition of mud and the like, and have said plurality of first apertures penetrating laterally therethrough; and said track engaging means comprise clevises that fittingly engage said lugs and have said plurality of second aperture penetrating laterally through the depending flanges of the U-shape of clevises and alignable with said first aperture for mounting.

14. A method of connecting and disconnecting rapidly attachments to and from a multi-purpose off-road vehicle having a frame carried by a plurality of wheels and carrying a prime mover and power source for operating said attachments the improvement comprising:

a. providing quick connect fittings on both said vehicle and said attachments for facilitating rapidly connecting and disconnecting a motive power supply for operating said attachments;

b. providing a first portion of attachment means comprising a plurality of aligned mounting stations along a front pair of substantially horizontal track means and providing a plurality of mounting apertures at each said mounting station;

c. providing a first portion of attachment means at the front and rear of said vehicle, each first portion comprising at least one mounting station at each of the front and rear respective pairs of vertical track means and providing a plurality of mounting apertures at each of said front and rear mounting stations;

laterally aligning all of said pairs of track means such that attachment means of the respective attachments can be mounted at any of said mounting stations for great flexibility in operation;

d. providing a plurality of attachments, each having a second portion of attachment means comprising a pair of track engaging means adapted to fittingly engage a pair of said track means and having a plurality of apertures adapted to align with said apertures in said track means at respective mounting stations;

e. providing pin means for inserting through aligned said apertures in said first and second portions of said attachment means;

f. emplacing said second portion of an attachment means engaging said first portion on said vehicle and inserting said pin means in said apertures for mounting said attachment; and g. removing said pin means from said apertures for removing said attachment readily when another attachment is desired to be emplaced.

15. The method of claim 14 wherein there is provided at each mounting station a plurality of apertures spaced longitudinally along each said track means for multiple point mounting and wherein there are provided a plurality of apertures in each of the track engaging means, said plurality of apertures being spaced apart at equal and second predetermined distances so as to coengage and facilitate ready insertion of said pin means for the multiple point mounting at each mounting station.

16. The method of claim 14 wherein there are provided a plurality of mounting stations along said horizontal track means at the front of said vehicle including at least a rearward mounting station and a forward mounting station, each mounting station having a plurality of apertures for mounting said attachments thereat; providing said forward mounting station sufficiently forward as to allow extended forward operation of said attachment; said extended forward operation being more remote from said vehicle than said rearward mounting station such that said attachment can be operated without having to move said vehicle so close to an impediment such as a ditch, thereby preventing cave-ins or the like.

* * * * *